US011892226B2

(12) United States Patent
Chauhan et al.

(10) Patent No.: US 11,892,226 B2
(45) Date of Patent: Feb. 6, 2024

(54) REFRIGERATION UNIT AND METHOD OF ASSEMBLING

(71) Applicant: Whirlpool Corporation, Benton Harbor, MI (US)

(72) Inventors: Vishal B. Chauhan, Palghar (IN); Rahul Subhash Chhajed, Pune (IN); Koteswara Rao Gochika, Pune (IN); Alberto Regio Gomes, St. Joseph, MI (US); Lynne F. Hunter, Dorr, MI (US); Jacob Charles Ickes, Baroda, MI (US); Narendra Ashok Kapure, Pune (IN); Mansi Katkar, Pune (IN); Mandar G. Kulkarni, Pune (IN); Dustin Michael Miller, South Bend, IN (US); Abhay Naik, Stevensville, MI (US); Manjunathraddi Navalgund, Pune (IN); Rafael D. Nunes, St. Joseph, MI (US); Sanjesh Kumar Pathak, Stevensville, MI (US); Sanket Vivek Phalak, Pune (IN); Anup R. Shedage, Pune (IN); Arpit Vijay, Rajasthan (IN); Giulia Marinello, Milan (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/547,412

(22) Filed: Dec. 10, 2021

(65) Prior Publication Data

US 2023/0184480 A1 Jun. 15, 2023

(51) Int. Cl.
*F25D 23/00* (2006.01)
*F25B 39/02* (2006.01)
(Continued)

(52) U.S. Cl.
CPC ..... *F25D 23/006* (2013.01); *F25B 39/02* (2013.01); *F25B 49/005* (2013.01);
(Continued)

(58) Field of Classification Search
CPC .... F25D 23/006; F25D 23/066; F25D 29/005; F25B 39/02; F25B 49/005; F25B 2339/02; F25B 2500/222
See application file for complete search history.

(56) References Cited

U.S. PATENT DOCUMENTS 3,373,478 A 3/1968 Simmonds, Jr.
4,539,737 A 9/1985 Kerpers et al.
(Continued)

FOREIGN PATENT DOCUMENTS

CN 203815463 U 9/2014
CN 104075519 A 10/2014
(Continued)

OTHER PUBLICATIONS

Pdf is translation of foreign reference KR 100918193 B1 (Year: 2009).*

*Primary Examiner* — Henry T Crenshaw
*Assistant Examiner* — Kamran Tavakoldavani
(74) *Attorney, Agent, or Firm* — Price Heneveld LLP

(57) ABSTRACT

A method of assembling a refrigeration unit includes inserting a machine compartment assembly, including a base plate and a compressor coupled to the base plate, into a machine compartment of the refrigeration unit, mounting a control box of the refrigeration unit to a side panel, and coupling the side panel to the refrigeration unit, such that the side panel conceals a lateral side of the machine compartment and the control box is laterally-inboard of the side panel.

20 Claims, 10 Drawing Sheets

(51) Int. Cl.
*F25B 49/00* (2006.01)
*F25D 23/06* (2006.01)
*F25D 29/00* (2006.01)

(52) U.S. Cl.
CPC ..... *F25D 23/066* (2013.01); *F25D 29/005* (2013.01); *F25B 2339/02* (2013.01); *F25B 2500/222* (2013.01)

(56) References Cited

U.S. PATENT DOCUMENTS

| | | | | |
|---|---|---|---|---|
| 6,948,324 | B2 | 9/2005 | Jin | |
| 7,448,225 | B2 | 11/2008 | Iguchi et al. | |
| 7,478,761 | B2 | 1/2009 | Karamanos et al. | |
| 2005/0086952 | A1 | 4/2005 | Nonaka et al. | |
| 2006/0117789 | A1 | 6/2006 | Yamasaki et al. | |
| 2007/0215333 | A1* | 9/2007 | Viklund | F28D 7/0016 165/172 |
| 2012/0060543 | A1* | 3/2012 | Hanley | F16L 59/065 62/440 |
| 2015/0292821 | A1 | 10/2015 | Sueleyman et al. | |
| 2016/0146526 | A1* | 5/2016 | Gaplikow | F25D 29/008 62/344 |
| 2020/0033049 | A1 | 1/2020 | Dherde et al. | |
| 2020/0363118 | A1* | 11/2020 | Cha | F25D 17/062 |
| 2021/0010726 | A1* | 1/2021 | Wang | F25B 13/00 |
| 2021/0190413 | A1 | 6/2021 | Marinello et al. | |

FOREIGN PATENT DOCUMENTS

| | | | |
|---|---|---|---|
| CN | 111536741 | A | 8/2020 |
| DE | 102011004590 | A1 | 8/2012 |
| DE | 102019216094 | A1 | 4/2021 |
| GB | 2275327 | A | 8/1994 |
| KR | 890013956 | U | 8/1989 |
| KR | 19990039331 | U | 11/1999 |
| KR | 100918193 | B1 * | 9/2009 |
| KR | 20190010340 | A | 1/2019 |
| WO | 2014142130 | A1 | 9/2014 |
| WO | 2020134954 | A1 | 7/2020 |

* cited by examiner

REFRIGERATION UNIT AND METHOD OF ASSEMBLING

BACKGROUND OF THE DISCLOSURE

The present disclosure generally relates to a refrigeration unit and, more specifically, to a method for assembling a refrigeration unit.

SUMMARY OF THE DISCLOSURE

According to one aspect of the present disclosure, a refrigeration unit includes a cabinet and a first evaporator assembly operable between an uninstalled condition and an installed condition. In the uninstalled condition of the first evaporator assembly, the first evaporator assembly is not assembled with the cabinet. In the installed condition of the first evaporator assembly, the first evaporator assembly is assembled with the cabinet. The first evaporator assembly includes a first evaporator, a first suction line connected to the first evaporator at a first suction line joint, a first capillary tube connected to the first evaporator at a first capillary tube joint, and an insulating sleeve disposed about the first suction line and the first capillary tube. The first suction line joint and the first capillary tube joint of the first evaporator assembly are leak testable in the uninstalled condition of the first evaporator assembly.

According to another aspect of the present disclosure, a method of assembling a refrigeration unit includes connecting a suction line to an evaporator at a suction line joint, connecting a capillary tube to the evaporator at a capillary tube joint, testing the suction line joint and capillary tube joint for leaks via a gas leak test, inserting the suction line and capillary tube into an insulating sleeve, and installing the evaporator within a cabinet and feeding the sleeved suction line and capillary tube through a pass-through opening defined by the cabinet after testing the suction line joint and capillary tube joint for leaks.

According to yet another aspect of the present disclosure, a method of assembling a refrigeration unit includes inserting a machine compartment assembly, including a base plate and a compressor coupled to the base plate, into a machine compartment of the refrigeration unit, mounting a control box of the refrigeration unit to a side panel, and coupling the side panel to the refrigeration unit, such that the side panel conceals a lateral side of the machine compartment and the control box is laterally-inboard of the side panel.

These and other features, advantages, and objects of the present disclosure will be further understood and appreciated by those skilled in the art by reference to the following specification, claims, and appended drawings.

Figure 1:
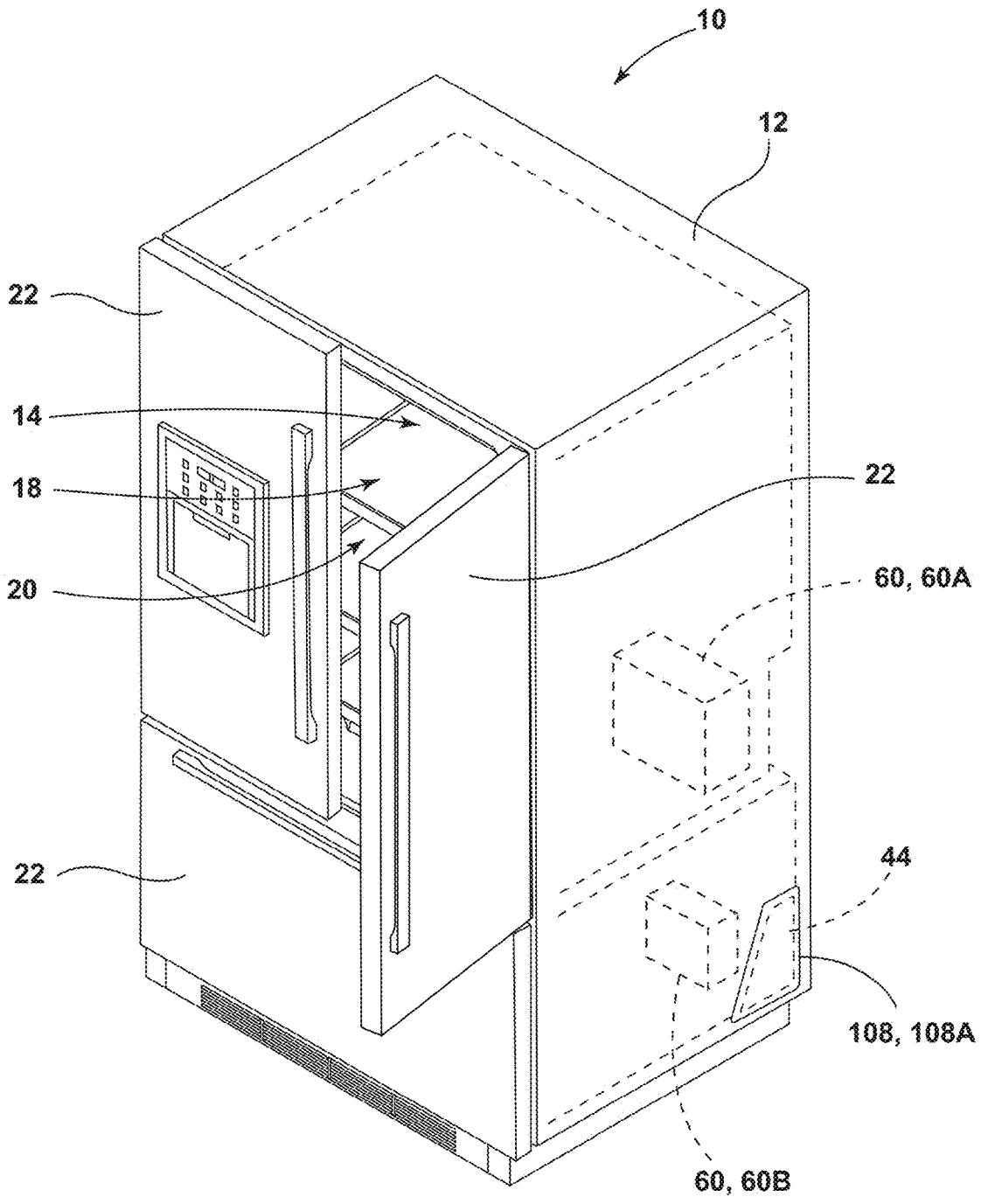
FIG. 1 is a top perspective view of a refrigeration unit.

The components in the figures are not necessarily to scale, emphasis instead being placed upon illustrating the principles described herein.

DETAILED DESCRIPTION

The present illustrated embodiments reside primarily in combinations of method steps and apparatus components related to a refrigeration unit. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to FIG. 1, a refrigeration unit 10 includes a cabinet 12. The cabinet 12 can be a vacuum insulated cabinet having at least one food storage space 14 that may be refrigerated. In the illustrated embodiment, the cabinet 12 includes two food storage spaces 14—a freezer compartment 16 and a refrigerator compartment 18. The cabinet 12 includes at least one access opening 20 that permits items (e.g., consumable goods) to be placed in the at least one food storage space 14. As illustrated in FIG. 1, the cabinet 12 includes two access openings 20 that respectively provide access to the freezer compartment 16 and the refrigerator compartment 18 above the freezer compartment 16. The refrigeration unit 10 may include at least one door 22 to selectively conceal the at least one access opening 20.

Figure 2:
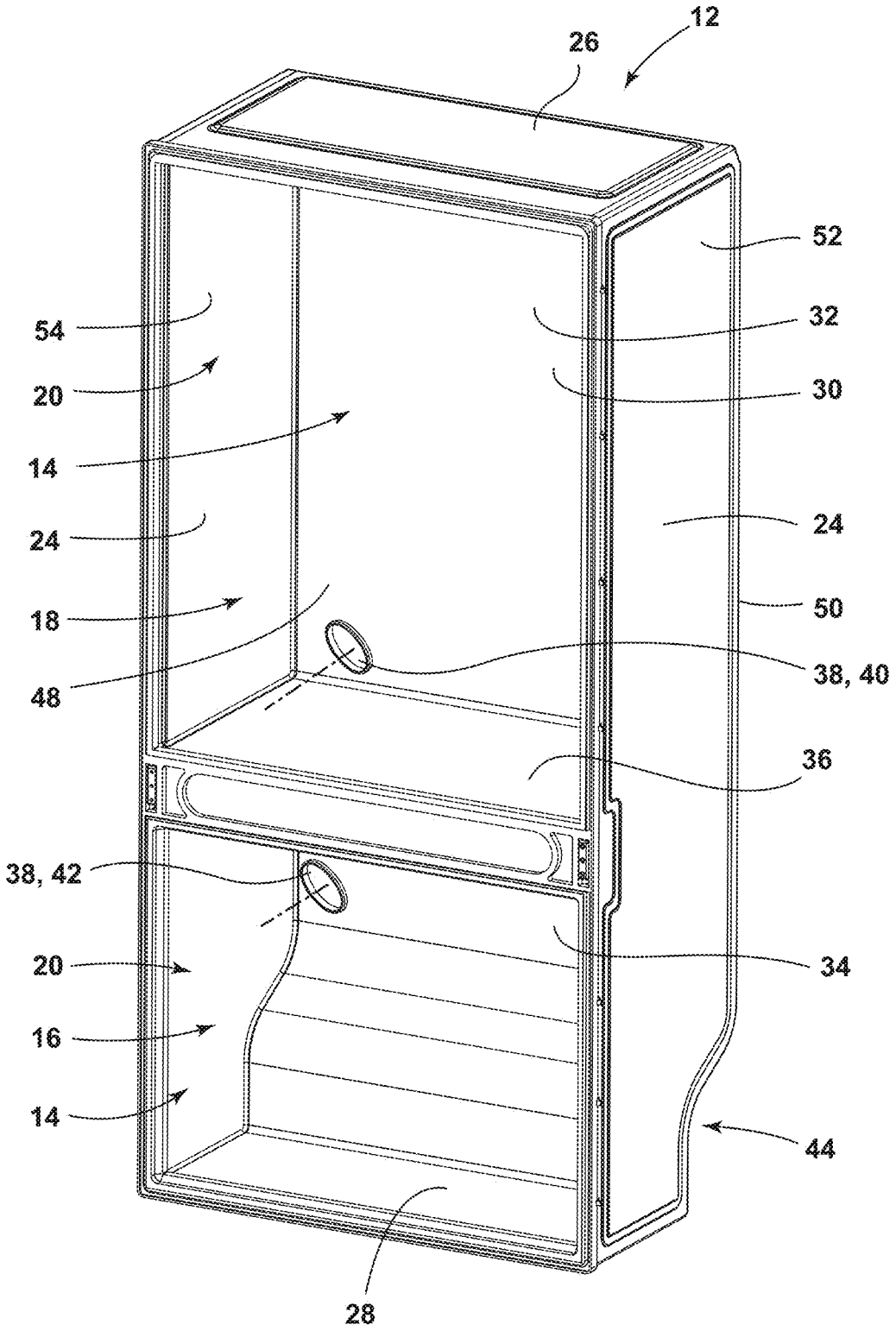
FIG. 2 is a top perspective view of a cabinet of a refrigeration unit.

Referring now to FIG. 2, the cabinet 12 includes upright sidewalls 24, and horizontally extending upper and lower sidewalls 26, 28. An upright rear sidewall 30 of the cabinet 12 includes an upper portion 32 and a lower portion 34. The upper and lower portions 32, 34 are separated by a horizontal divider structure 36. The rear sidewall 30 includes at least one pass-through opening 38. In the illustrated embodiment, the rear sidewall 30 includes an upper pass-through opening 40 in the upper portion 32 of the rear sidewall 30 and a lower pass-through opening 42 in the lower portion 34 of the rear sidewall 30. The lower portion 34 of the rear sidewall 30 may include a forwardly extending portion that forms a space (see also FIG. 1). In various implementations, the space may be utilized as a machine compartment 44 for receiving a machine compartment assembly 46 therein, as described further herein. The pass-through openings 38 extend between inner and outer sides 48, 50 of the rear sidewall 30. The inner and outer sides 48, 50 of the rear sidewall 30 generally face opposite directions. The cabinet 12 can include an outer wrapper 52 and an inner liner 54. The inner liner 54 and outer wrapper 52 may cooperate to define an internal cavity 56 for receiving insulation material therein. The internal cavity 56 may form a vacuum space that is substantially filled with porous filler material. In some implementations, the cabinet 12 may include a vacuum panel structure having a plurality of pre-formed vacuum core members or boards (not shown) disposed between the outer wrapper 52 and the inner liner 54.

Figure 3:
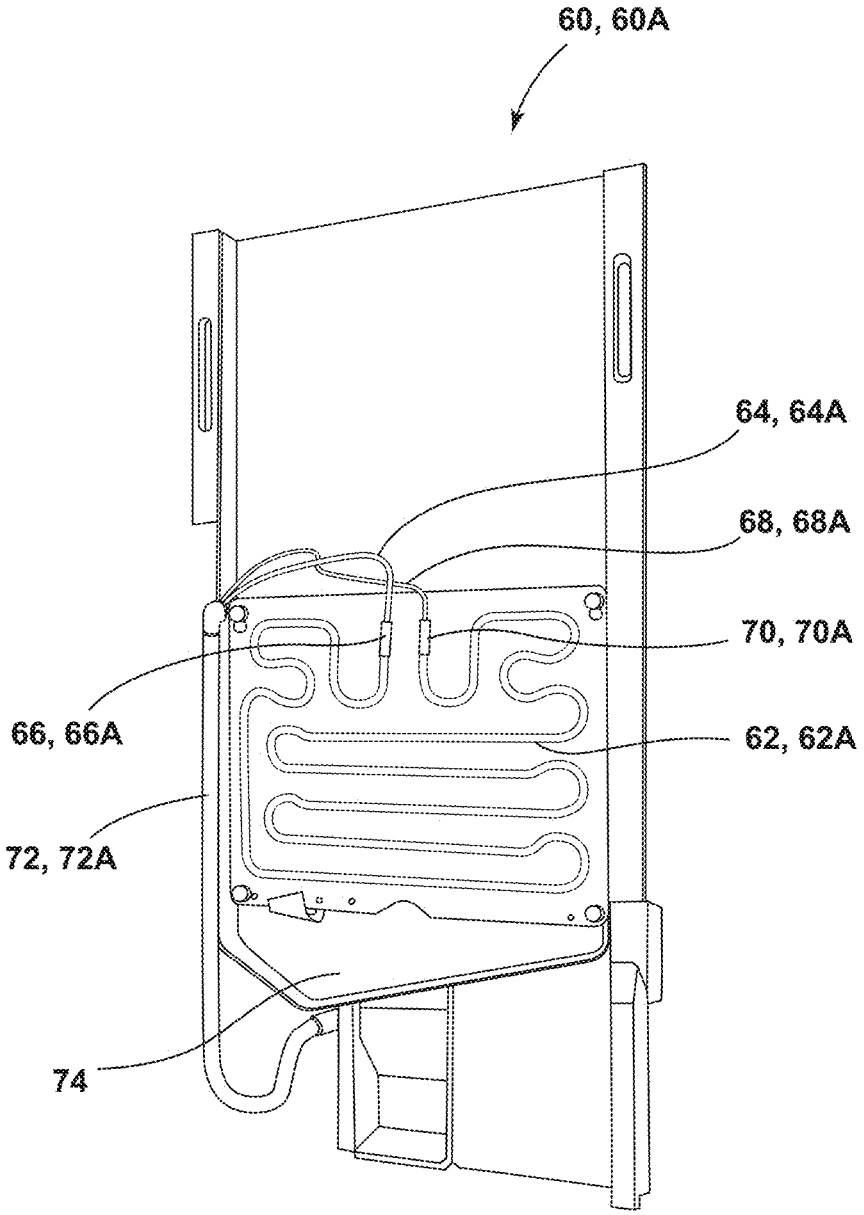
FIG. 3 is a side perspective view of an evaporator assembly.
Figure 4:
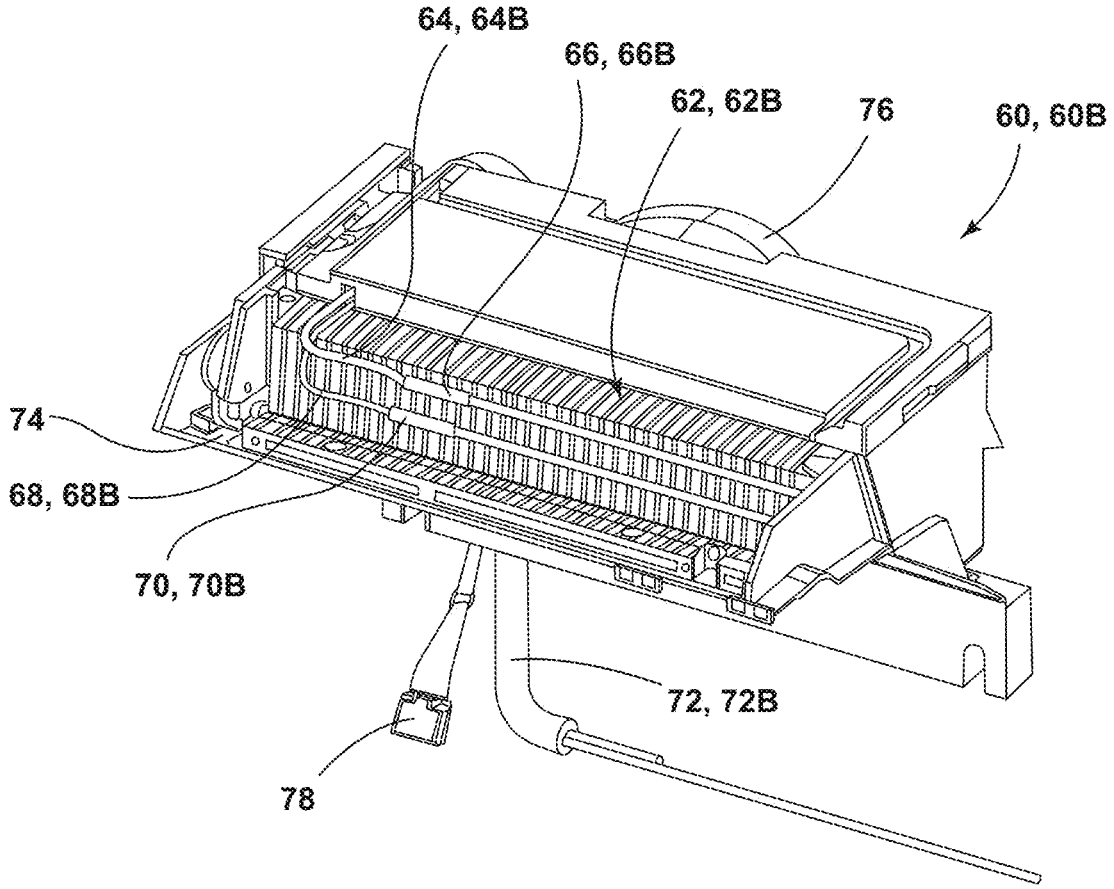
FIG. 4 is a top perspective view of an evaporator assembly.

Referring now to FIGS. 1, 3, and 4, the refrigeration unit 10 includes an evaporator assembly 60. As described further herein, the evaporator assembly 60 may be a subassembly of the refrigeration unit 10 that is operable between an uninstalled condition and an installed condition. In the installed condition of the evaporator assembly 60, the evaporator assembly 60 may be positioned proximate to the at least one food storage space 14 of the cabinet 12 and configured to cool the at least one food storage space 14. The evaporator assembly 60 includes an evaporator 62, a suction line 64 connected to the evaporator 62 at a suction line joint 66, and a capillary tube 68 connected to the evaporator 62 at a capillary tube joint 70. The evaporator assembly 60 further includes an insulating sleeve 72 that is disposed about the suction line 64 and the capillary tube 68. In various implementations, the evaporator assembly 60 can include a variety of additional components. For example, the evaporator assembly 60 can include a drain pan 74, a heating element (not shown), a drain tube (not shown) coupled to the drain pan 74, an evaporator fan assembly 76, a wiring harness 78 for wires electrically coupled to the evaporator fan assembly 76 and/or the heating element, insulation panels (e.g., expanded polystyrene panels), and/or one or more trim panels, such as a trim partition that defines the food storage space 14 of the refrigeration unit 10 and separates the food storage space 14 from the evaporator 62.

Referring to FIGS. 2-6, the evaporator assembly 60 is operable between the uninstalled condition, wherein the evaporator assembly 60 is not assembled with the cabinet 12 of the refrigeration unit 10, and the installed condition, wherein the evaporator assembly 60 is assembled with the cabinet 12. In some implementations, in the installed condition of the evaporator assembly 60, the capillary tube 68 and suction line 64, as well as the insulating sleeve 72 disposed about the capillary tube 68 and suction line 64, extend through the pass-through opening 38 defined by the cabinet 12 of the refrigeration unit 10. In some implementations, a pass-through opening insulation feature 80 is configured to be fitted into the pass-through opening 38, and the insulating sleeve 72, suction line 64, and capillary tube 68 of the evaporator assembly 60 are configured to extend through the pass-through opening insulation feature 80. For example, as illustrated in FIG. 7, the pass-through opening 38 is defined by the inner liner 54 and the outer wrapper 52 of the cabinet 12, the pass-through opening insulation feature 80 is fitted within the pass-through opening 38, and the insulating sleeve 72 and the suction line 64 disposed therein extend through the pass-through opening 38 via an aperture 82 defined by the pass-through opening insulation feature 80. In some implementations, the wiring harness 78 of the evaporator assembly 60 may also extend through the pass-through opening 38 and/or the pass-through opening insulation feature 80 in the installed condition of the evaporator assembly 60.

In various embodiments, the evaporator assembly 60 may be leak-testable in the uninstalled condition. For example, in the uninstalled condition, the capillary tube joint 70 that connects the capillary tube 68 to the evaporator 62 and/or the suction line joint 66 that connects the suction line 64 to the evaporator 62 can be leak tested to determine whether the suction line and capillary tube joints 66, 70 are sealed in a manner sufficient for operation of the refrigeration unit 10. It is contemplated that the capillary tube and suction line joints 70, 66 can be tested via a variety of leak testing methods. In various implementations, the suction line and capillary tube joints 66, 70 may undergo a gas leak test in the uninstalled condition of the evaporator assembly 60, such as a helium leak test. Leak testing the evaporator assembly 60 in the uninstalled condition is advantageous in that defects in the evaporator assembly 60, such as an insufficiently sealed joint, can be identified before the evaporator assembly 60 is installed into the refrigeration unit 10. The capillary tube 68 and suction line 64 extending through the pass-through opening 38 of the cabinet 12 in the installed condition and being insulated by the insulating sleeve 72, rather than extending between the inner liner 54 and the outer wrapper 52 of the cabinet 12 and being insulated by insulation material 58 within the internal cavity 56 of the cabinet 12 directly, is also advantageous, as the evaporator assembly 60 may be repaired or replaced if a leak is detected without ruining the cabinet 12.

Figure 5:
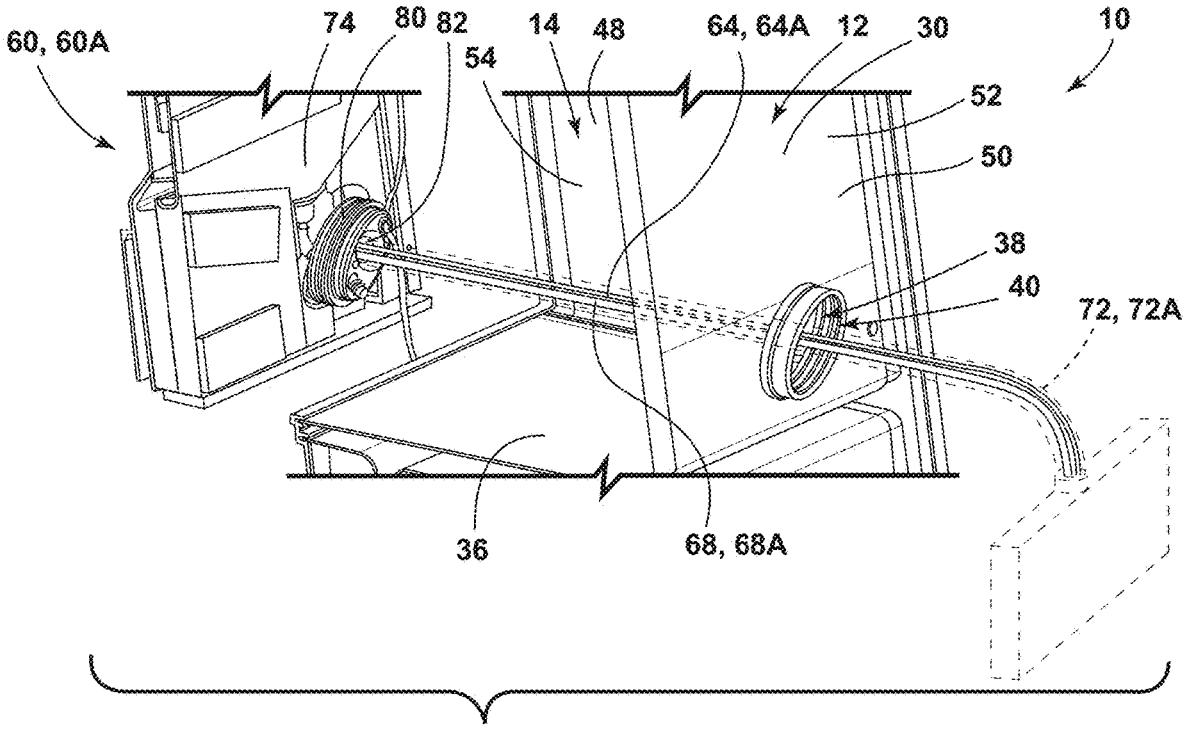
FIG. 5 is a partial rear perspective view of a cabinet of a refrigeration unit and an evaporator assembly configured to be installed in the cabinet.
Figure 6:
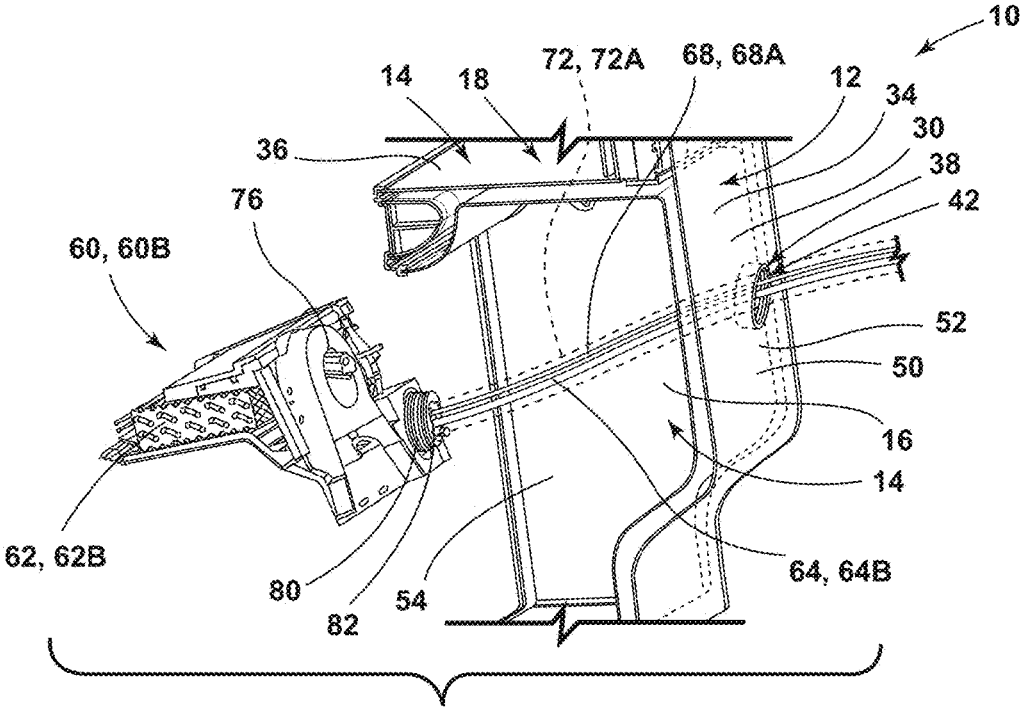
FIG. 6 is a partial rear perspective view of a cabinet and an evaporator assembly configured to be installed in the cabinet.
Figure 7:
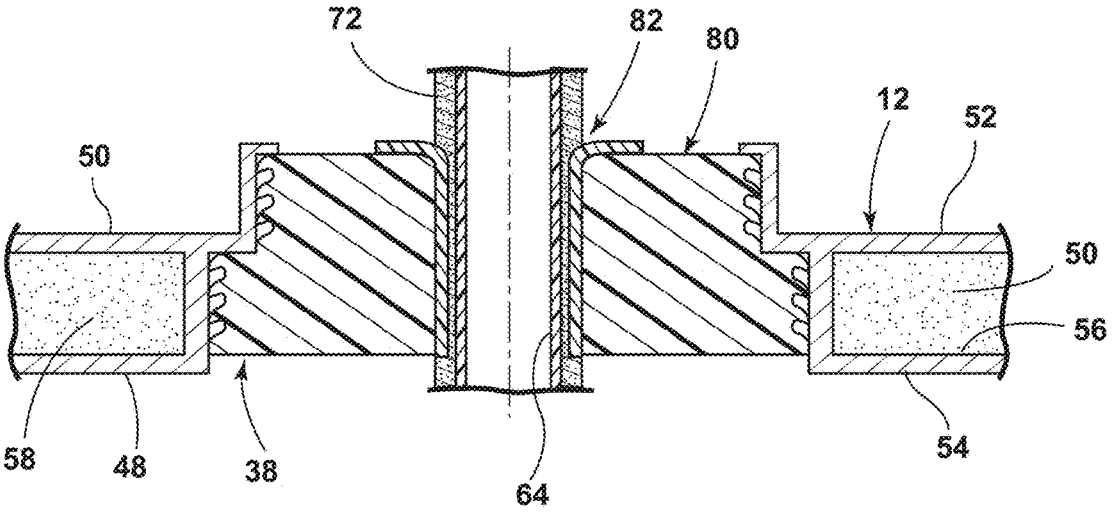
FIG. 7 is a cross-sectional view of a pass-through opening defined by a cabinet of a refrigeration unit.

Referring now to FIGS. 1 and 3-6, in some implementations, the refrigeration unit 10 includes a plurality of evaporator assemblies 60. For example, the refrigeration unit 10 can include a first evaporator assembly 60A, as illustrated in FIGS. 3 and 5, and a second evaporator assembly 60B, as illustrated in FIGS. 4 and 6. In the embodiments illustrated in FIGS. 1, 5, and 6, the first evaporator assembly 60A is positioned proximate to the refrigerator compartment 18 of the refrigeration unit 10 and is configured to cool the refrigerator compartment 18 of the refrigeration unit 10 in the installed condition of the first evaporator assembly 60A. Further, the second evaporator assembly 60B is positioned proximate to the freezer compartment 16 of the refrigeration unit 10 and is configured to cool the freezer compartment 16 of the refrigeration unit 10 in the installed condition. It is contemplated that the first evaporator assembly 60A can be positioned proximate to and be configured to cool the freezer compartment 16, in some implementations. Further, the second evaporator assembly 60B can be positioned proximate to and be configured to cool the refrigerator compartment 18, in some implementations.

As illustrated in FIG. 3, the first evaporator assembly 60A includes a first evaporator 62A, a first suction line 64A that is connected to the first evaporator 62A at a first suction line joint 66A, and a first capillary tube 68A that is connected to the first evaporator 62A at a first capillary tube joint 70A. A first insulating sleeve 72A is disposed about the first capillary tube 68A and the first suction line 64A. In the embodiment illustrated in FIG. 5, the first evaporator assembly 60A is configured to be installed into the refrigeration unit 10, such that the first evaporator 62A is positioned proximate to the refrigerator compartment 18, which is above the freezer compartment 16. In the installed condition, the first insulating sleeve 72A, the first suction line 64A within the first insulating sleeve 72A, and the first capillary tube 68A within the first insulating sleeve 72A extend through the upper pass-through opening 40 defined by the cabinet 12.

As illustrated in FIG. 4, the second evaporator assembly 60B includes a second evaporator 62B, a second suction line 64B connected to the second evaporator 62B by a second suction line joint 66B, and a second capillary tube 68B connected to the second evaporator 62B at a second capillary tube joint 70B. A second insulating sleeve 72B is disposed about the second capillary tube 68B and the second suction line 64B. In the embodiment illustrated in FIG. 6, the second evaporator assembly 60B is configured to be installed into the refrigeration unit 10 such that the second evaporator 62B is proximate to and configured to cool the freezer compartment 16 below the refrigerator compartment 18. The second insulating sleeve 72B, the second capillary tube 68B, and the second suction line 64B extend through the lower pass-through opening 42 in the installed condition of the second evaporator assembly 60B. In various embodiments, the first and second evaporator assemblies 60A, 60B are configured to be leak tested in the uninstalled conditions, respectively.

Figure 8:
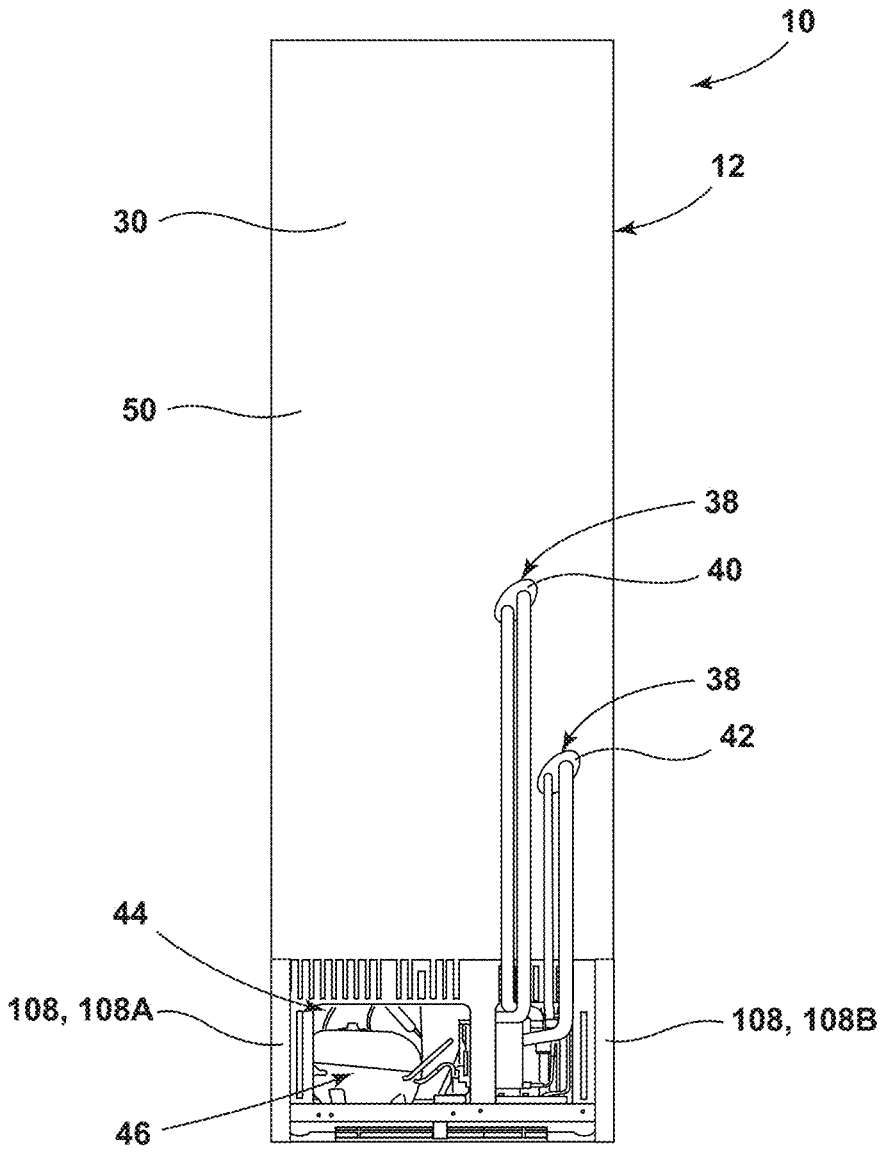
FIG. 8 is a rear elevational view of a refrigeration unit illustrating a machine compartment.
Figure 9:
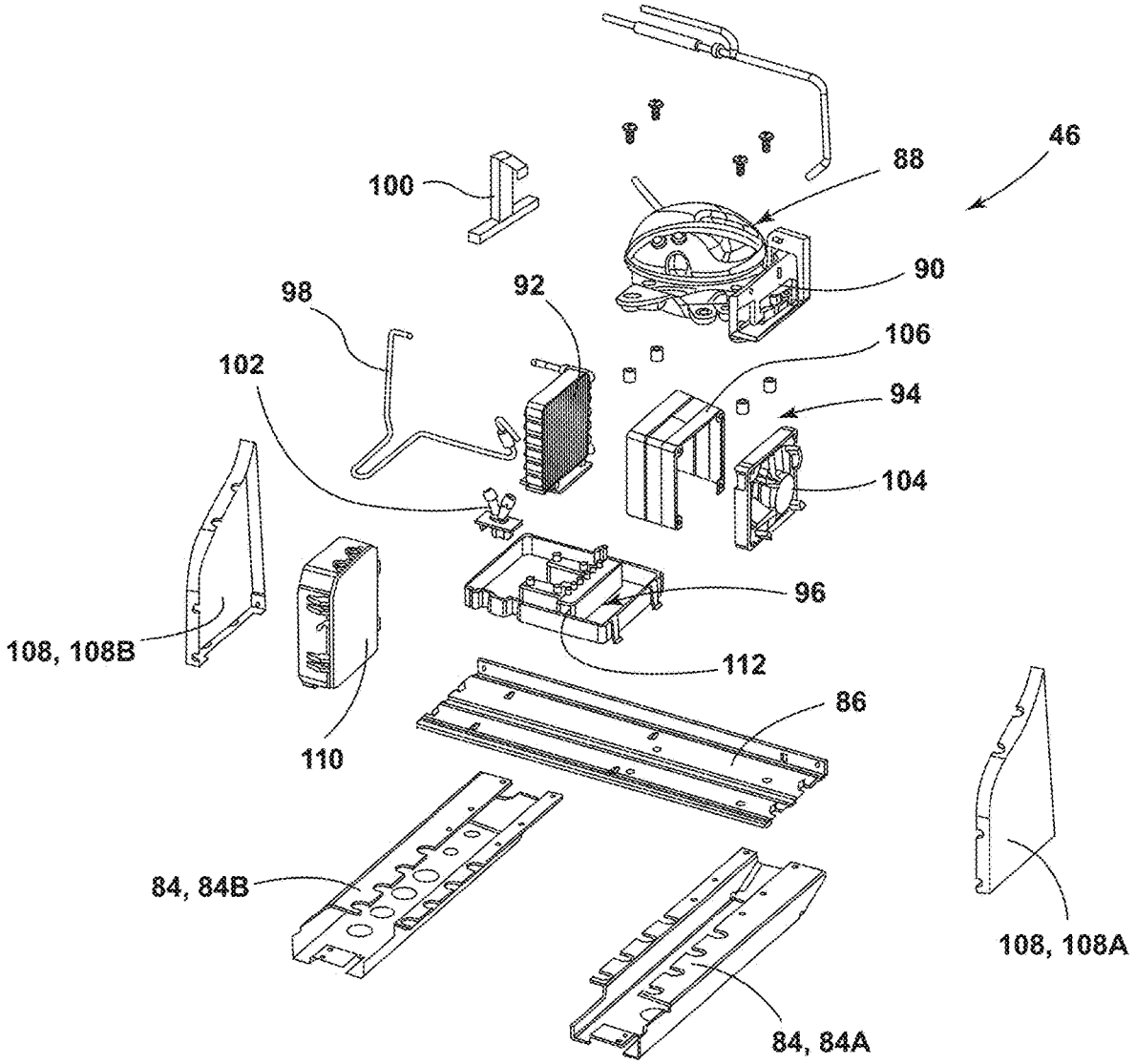
FIG. 9 is an exploded view of a machine compartment assembly of a refrigeration unit.
Figure 10:
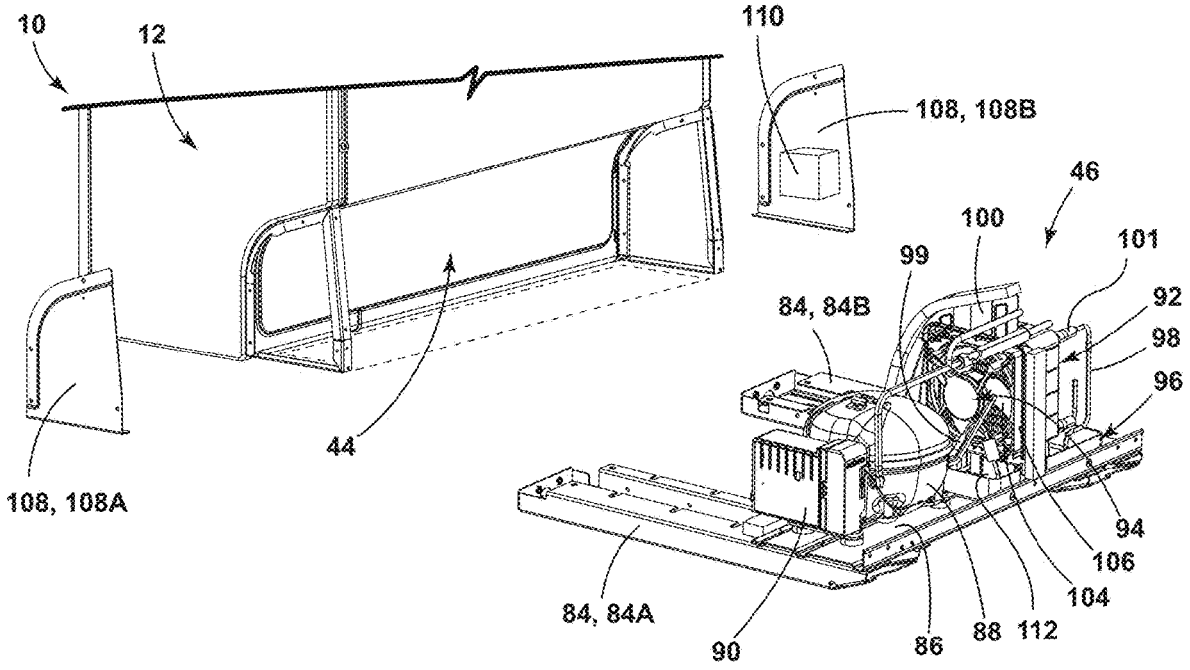
FIG. 10 is a rear perspective view of a refrigeration unit illustrating a machine compartment, first and second side panels configured to cover lateral sides of the machine compartment, and a machine compartment assembly configured to be received within the machine compartment.

Referring now to FIGS. 8-10, the refrigeration unit 10 includes a machine compartment assembly 46. The machine compartment assembly 46 is operable between an installed condition, wherein the machine compartment assembly 46 is installed within the machine compartment 44 of the refrigeration unit 10, as illustrated in FIG. 8, and an uninstalled condition, wherein the machine compartment assembly 46 is not installed in the machine compartment 44, as illustrated in FIG. 10.

Referring now to FIG. 9, the machine compartment assembly 46 can include a plurality of components. For example, as illustrated in FIG. 9, the machine compartment assembly 46 includes first and second guide rails 84A, 84B, a base plate 86, a compressor 88, an inverter 90, a condenser 92, a condenser fan assembly 94, a water tray 96, a pre-condenser tube 98, a bracket 100, and a drain tube connector 102. In an assembled condition of the machine compartment assembly 46, as illustrated in FIG. 10, the first and second guide rails 84A, 84B are spaced apart from each other and extend substantially parallel to each other in a front-to-back direction of the refrigeration unit 10. The base plate 86 is mounted to the first and second guide rails 84A, 84B and extends there-between. The compressor 88 and inverter 90 are coupled to the base plate 86 proximate to the first guide rail 84A. The water tray 96 is coupled to the base plate 86 a distance from the first guide rail 84A that is further than a distance of the compressor 88 from the first guide rail 84A. The bracket 100 is coupled to the water tray 96 and extends upward therefrom above (i.e., directly-upward of) the water tray 96. The condenser 92 is coupled to the bracket 100 and is positioned above the water tray 96. The pre-condenser tube 98 extends from the compressor 88 to the condenser 92 and is connected to the compressor 88 at a compressor joint 99 and the condenser 92 at a condenser joint 101. The condenser fan assembly 94, which includes a condenser fan 104 and a condenser fan shroud 106, is coupled to the bracket 100 and positioned between the compressor 88 and the condenser 92.

Referring to FIGS. 1, 9, and 10, at least one side panel 108 is configured to be coupled to the cabinet 12. As illustrated in FIG. 1, the at least one side panel 108 is configured to cover at least one lateral side of the machine compartment 44. In various implementations, two side panels 108 are configured to be coupled to opposite sides of the cabinet 12. For example, as illustrated in FIG. 10, first and second side panels 108A, 108B are configured to be coupled to opposite sides of the cabinet 12 and cover the respective opposite open lateral sides of the machine compartment 44. In the illustrated embodiment, the first side panel 108A is proximate to the first guide rail 84A, and the second side panel 108B is proximate to the second guide rail 84B.

As illustrated in FIGS. 9 and 10, the refrigeration unit 10 includes a control box 110. The control box 110 may include a controller for controlling various electronic components of the refrigeration unit 10 (e.g., evaporator fan assembly 76, condenser fan assembly 94, valves, compressor 88, etc.). The control box 110 may be electrically coupled to the electronic components via wires of the one or more wiring harnesses 78, in a fully assembled condition of the refrigeration unit 10. In some implementations, the control box 110 is mounted to the at least one side panel 108. In various embodiments, the control box 110 is mounted to the at least one side panel 108, such that the control box 110 is positioned laterally inboard of the at least one side panel 108 when the at least one side panel 108 is coupled to the cabinet 12. For example, as illustrated in FIG. 10, the control box 110 is mounted to an inboard side of the second side panel 108B, such that the control box 110 would be positioned within the machine compartment 44, laterally inboard of the second side panel 108B when the second side panel 108B is coupled to the cabinet 12.

In some implementations, the control box 110 is mounted to the side panel 108 at an elevated position within the machine compartment 44. For example, in some implementations, the control box 110 is mounted to the side panel 108, such that the control box 110 is wholly upward of the base plate 86 of the machine compartment assembly 46 when the side panel 108 is coupled to the cabinet 12. In some implementations, the control box 110 is mounted to the side panel 108, such that the control box 110 is wholly above an upper rim 112 of the water tray 96 that defines an upper opening to the water tray 96 when the side panel 108 is coupled to the cabinet 12. The elevated position of the control box 110 within the machine compartment 44 may advantageously prevent water overflows from reaching the control box 110. Additionally, the control box 110 being coupled to the inboard side of the removable side panel 108 may advantageously allow the control box 110 to be concealed within the machine compartment 44 when the side panel 108 is coupled to the cabinet 12 and yet conveniently serviceable via removal of the side panel 108 from the cabinet 12.

Figure 11:
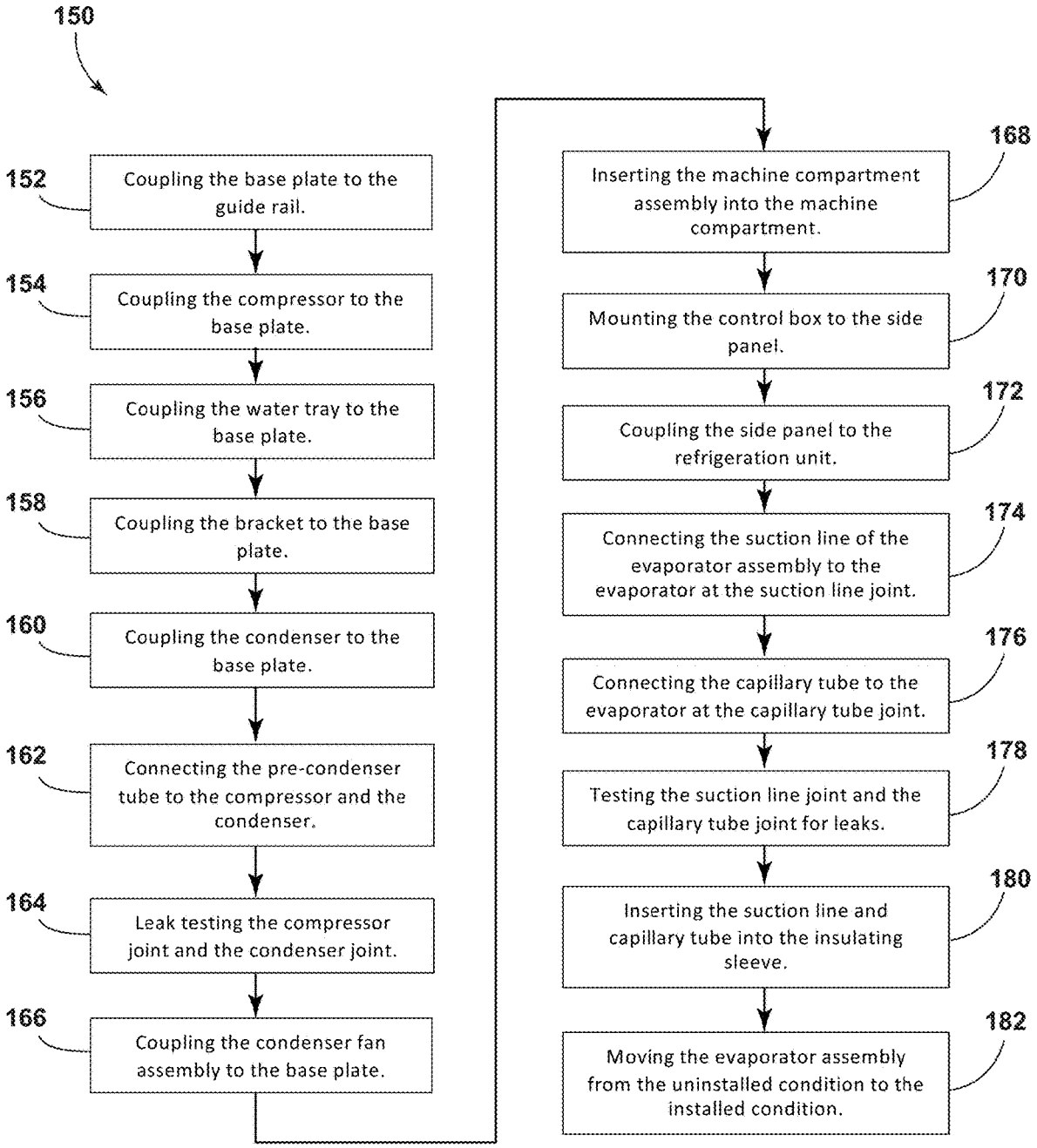
FIG. 11 is a block diagram of a method of assembling a refrigeration unit.

Referring now to FIG. 11, a method 150 for assembling the refrigeration unit 10 includes a step 152 that includes coupling the base plate 86 to the guide rail 84. In various implementations, the base plate 86 may be coupled to the first and second guide rails 84A, 84B, as illustrated in FIG. 10. The method 150 of assembling the refrigeration unit 10 may further include a step 154 which includes coupling the compressor 88 to the base plate 86. As illustrated in FIG. 10, the compressor 88 may be bolted to the base plate 86 proximate to the first guide rail 84A of the machine compartment assembly 46. In some embodiments of the method 150, the step 154 may be performed after the step 152 of coupling the base plate 86 to the guide rail 84.

The method 150 of assembling the refrigeration unit 10 may further include a step 156 that includes coupling the water tray 96 to the base plate 86. The water tray 96 may be coupled to the base plate 86 such that the water tray 96 is further than the compressor 88 from the first guide rail 84A. In some embodiments of the method 150, the step 156 is performed after step 152 and/or step 154. In an exemplary embodiment, step 154 is performed after step 152 and step 156 is performed after step 154.

The method 150 of assembling the refrigeration unit 10 may further include a step 158 that includes coupling the bracket 100 to the base plate 86. In some implementations, the step 158 of coupling the bracket 100 to the base plate 86 comprises coupling the bracket 100 to the water tray 96 coupled to the base plate 86. In some embodiments of the method 150, the step 158 is performed after step 152, 154, and/or step 156. In an exemplary embodiment, step 154 is performed after step 152, step 156 is performed after step 154, and step 158 is performed after step 156.

The method 150 of assembling the refrigeration unit 10 may further include a step 160 that includes coupling the condenser 92 to the base plate 86. In some implementations, the step 160 of coupling the condenser 92 to the base plate 86 comprises coupling the condenser 92 to the bracket 100 that is coupled to the water tray 96, as illustrated in FIG. 10. The step 160 may be performed after step 152, 154, 156, and/or step 158. In an exemplary embodiment, step 154 is performed after step 152, step 156 is performed after step 154, step 158 is performed after step 156, and step 160 is performed after step 158.

The method 150 of assembling the refrigeration unit 10 may further include a step 162 that includes connecting the pre-condenser tube 98 to the compressor 88 and the condenser 92. The pre-condenser tube 98 may be connected to the compressor 88 at the compressor joint 99 and may be connected to the condenser 92 at the condenser joint 101. The step 162 may be performed after step 152, 154, 156, 158 and/or step 160. In an exemplary embodiment, step 154 is performed after step 152, step 156 is performed after step 154, step 158 is performed after step 156, step 160 is performed after step 158, and step 162 is performed after step 160.

The method 150 of assembling the refrigeration unit 10 may further include a step 164 that includes leak testing the compressor joint 99 and the condenser joint 101. In some implementations, the step 164 of leak testing the compressor joint 99 and the condenser joint 101 may precede a step 168 that includes inserting the machine compartment assembly 46 into the machine compartment 44, as described further herein. The compressor joint 99 and the condenser joint 101 may be leak tested via a variety of leak testing methods, such as a helium leak test or other gas leak test.

The method 150 of assembling the refrigeration unit 10 may further include a step 166 that includes coupling the condenser fan assembly 94 to the base plate 86. In some implementations, the step 166 of coupling the condenser fan assembly 94 to the base plate 86 may comprise coupling the condenser fan assembly 94 to the bracket 100 coupled to the water tray 96 that is coupled to the base plate 86. The step 166 may be performed after step 152, 154, 156, 158, 160, and/or step 162. In an exemplary embodiment, step 154 is performed after step 152, step 156 is performed after step 154, step 158 is performed after step 156, step 160 is performed after step 158, step 162 is performed after step 160, and step 166 is performed after step 162.

The method 150 of assembling the refrigeration unit 10 may further include the step 168 that includes inserting the machine compartment assembly 46 into the machine compartment 44. In some implementations, the machine compartment assembly 46 may be slid into the machine compartment 44 via the first and second guide rails 84A, 84B of the machine compartment assembly 46. In some implementations, the step 168 of inserting the machine compartment assembly 46 into the machine compartment 44 may be performed after the step 164 of leak testing the compressor joint 99 and the condenser joint 101. As such, any leaks from the compressor and/or condenser joints 99, 101 may be remedied before the machine compartment assembly 46 is positioned within the machine compartment 44 of the refrigeration unit 10. In some implementations of the method 150, the step 168 may be performed after step 152, 154, 156, 158, 160, 162, 164, and/or 166. In an exemplary embodiment, step 154 is performed after step 152, step 156 is performed after step 154, step 158 is performed after step 156, step 160 is performed after step 158, step 162 is performed after step 160, step 164 is performed after step 162, step 166 is performed after step 164, and step 168 is performed after step 166.

The method 150 of assembling the refrigeration unit 10 may further include a step 170 that includes mounting the control box 110 to the side panel 108. As described herein, the control box 110 may be mounted at a relatively elevated position on the side panel 108, in various implementations. The method 150 of assembling the refrigeration unit 10 may further include a step 172 that includes coupling the side panel 108 to the refrigeration unit 10. In some embodiments, the side panel 108 may be coupled to the refrigeration unit 10 in step 172, such that the side panel 108 conceals the lateral side of the machine compartment 44 and the control box 110 is positioned within the machine compartment 44, laterally-inboard of the side panel 108. In some implementations, the step 170 comprises mounting the control box 110 to a portion of the side panel 108, such that the control box 110 is positioned wholly upward of the base plate 86 of the machine compartment assembly 46 when the side panel 108 is coupled to the refrigeration unit 10 and the machine compartment assembly 46 is inserted within the machine compartment 44. In some implementations, the step 170 comprises mounting the control box 110 to a portion of the side panel 108, such that the control box 110 is positioned wholly upward of the upper rim 112 of the water tray 96 when the side panel 108 is coupled to the refrigeration unit 10 and the machine compartment assembly 46 is inserted within the machine compartment 44.

The method 150 of assembling the refrigeration unit 10 may further include a step 174 that includes connecting the suction line 64 of the evaporator assembly 60 to the evaporator 62 at the suction line joint 66. It is contemplated that the step 174 of connecting the suction line 64 of the evaporator assembly 60 to the evaporator 62 at the suction line joint 66 may be executed in a variety of fashions (e.g., brazing, press-fitting, Lokring®, etc.). The method 150 may further include a step 176 that includes connecting the capillary tube 68 to the evaporator 62 at the capillary tube joint 70. The method 150 of assembling the refrigeration unit 10 may further include a step 178 that includes testing the suction line joint 66 and the capillary tube joint 70 for leaks via a gas leak test. The step 178 of testing the suction line joint 66 and the capillary tube joint 70 may occur before installation of the evaporator assembly 60 into the refrigeration unit 10, as described further herein.

The method 150 of assembling the refrigeration unit 10 may further include a step 180 that includes inserting the suction line 64 and capillary tube 68 into the insulating sleeve 72. The insulating sleeve 72 may be formed of a variety of materials, such as foam. The method 150 of assembling the refrigeration unit 10 further includes a step 182 that includes moving the evaporator assembly 60 from the uninstalled condition to the installed condition. In some implementations, the step 182 may include installing the evaporator 62 within the cabinet 12 and feeding the sleeved suction line 64 and capillary tube 68 through the pass-through opening 38 defined by the cabinet 12. In some implementations, the step 182 may include feeding the sleeved suction line 64 and capillary tube 68 through the pass-through opening 38 that extends through the inner liner 54 and the outer wrapper 52 of the cabinet 12 that cooperate to define the internal cavity 56 for receiving insulation material 58 therein. The step 182 may include positioning the evaporator 62 proximate to the freezer compartment 16 of the refrigeration unit 10, such that the evaporator 62 is configured to cool the freezer compartment 16. In some embodiments, the step 182 may include positioning the evaporator 62 proximate to the refrigerator compartment 18 of the refrigeration unit 10, such that the evaporator 62 is configured to cool the refrigerator compartment 18. In various embodiments, the step 182 of moving the evaporator assembly 60 from the uninstalled condition to the installed condition is performed after the step 178 of testing the suction line joint 66 and the capillary tube joint 70 for leaks.

According to one aspect of the present disclosure, a refrigeration unit includes a cabinet and a first evaporator assembly operable between an uninstalled condition and an installed condition. In the uninstalled condition of the first evaporator assembly, the first evaporator assembly is not assembled with the cabinet. In the installed condition of the first evaporator assembly, the first evaporator assembly is assembled with the cabinet. The first evaporator assembly includes a first evaporator, a first suction line connected to the first evaporator at a first suction line joint, a first capillary tube connected to the first evaporator at a first capillary tube joint, and an insulating sleeve disposed about the first suction line and the first capillary tube. The first suction line joint and the first capillary tube joint of the first evaporator assembly are leak testable in the uninstalled condition of the first evaporator assembly.

According to yet another aspect of the present disclosure, the cabinet includes an inner liner, an outer wrapper, and a pass-through opening that extends through the inner liner and the outer wrapper. The inner liner and outer wrapper cooperate to define an internal cavity for receiving insulation material therein. Further, the insulating sleeve, and the first capillary tube and first suction line disposed within the insulating sleeve, extend through the pass-through opening in the assembled condition of the first evaporator assembly.

According to yet another aspect of the present disclosure, the first evaporator is positioned proximate to and is configured to cool a refrigerator compartment of the refrigeration unit in the installed condition of the first evaporator assembly.

According to yet another aspect, the present disclosure includes a second evaporator assembly operable between an uninstalled condition and an installed condition. In the uninstalled condition of the second evaporator assembly, the second evaporator assembly is not assembled with the cabinet. In the installed condition of the second evaporator assembly, the second evaporator assembly is assembled with the cabinet. The second evaporator assembly includes a second evaporator, a second suction line connected to the second evaporator at a second suction line joint, a second capillary tube connected to the second evaporator at a second capillary tube joint, and an insulating sleeve disposed about the second suction line and the second capillary tube. The second suction line joint and the second capillary tube joint of the second evaporator assembly are leak testable in the uninstalled condition of the second evaporator assembly.

According to yet another aspect of the present disclosure, the second evaporator is positioned proximate to and is configured to cool a freezer compartment of the refrigeration unit in the installed condition of the second evaporator assembly.

According to another aspect of the present disclosure, a method of assembling a refrigeration unit includes connecting a suction line to an evaporator at a suction line joint, connecting a capillary tube to the evaporator at a capillary tube joint, testing the suction line joint and capillary tube joint for leaks via a gas leak test, inserting the suction line and capillary tube into an insulating sleeve, and installing the evaporator within a cabinet and feeding the sleeved suction line and capillary tube through a pass-through opening defined by the cabinet after testing the suction line joint and capillary tube joint for leaks.

According to yet another aspect of the present disclosure, the step of installing the evaporator within the cabinet and feeding the sleeved suction line and capillary tube through the pass-through opening comprises feeding the sleeved suction line and capillary tube through the pass-through opening that extends through an inner liner and an outer wrapper of the cabinet that cooperate to define an internal cavity for receiving insulation material therein.

According to yet another aspect of the present disclosure, the step of installing the evaporator within the cabinet comprises positioning the evaporator proximate to the freezer compartment of the refrigeration unit, such that the evaporator is configured to cool the freezer compartment.

According to yet another aspect of the present disclosure, the step of installing the evaporator within the cabinet comprises positioning the evaporator proximate to the refrigerator compartment of the refrigeration unit, such that the evaporator is configured to cool the refrigerator compartment.

According to yet another aspect of the present disclosure, a method of assembling a refrigeration unit includes inserting a machine compartment assembly, including a base plate and a compressor coupled to the base plate, into a machine compartment of the refrigeration unit, mounting a control box of the refrigeration unit to a side panel, and coupling the side panel to the refrigeration unit, such that the side panel conceals a lateral side of the machine compartment and the control box is laterally-inboard of the side panel.

According to another aspect of the present disclosure, the step of mounting the control box comprises mounting the control box to a portion of the side panel, such that the control box is wholly upward of the base plate when the machine compartment assembly is inserted into the machine compartment and the side panel is coupled to the refrigeration unit.

According to yet another aspect, the present disclosure includes a step of coupling the compressor to the base plate. The step of coupling the compressor to the base plate precedes the step of inserting the machine compartment assembly into the machine compartment of the refrigeration unit.

According to yet another aspect, the present disclosure includes a step of coupling a water tray to the base plate. The step of coupling the water tray to the base plate precedes the step of inserting the machine compartment assembly into the machine compartment of the refrigeration unit.

According to yet another aspect of the present disclosure, the step of mounting the control box comprises mounting the control box to a portion of the side panel, such that the control box is wholly upward of an upper rim of the water tray when the machine compartment assembly is inserted into the machine compartment and the side panel is coupled to the refrigeration unit.

According to yet another aspect, the present disclosure includes a step of coupling a condenser to the base plate after the step of coupling the water tray to the base plate and before the step of inserting the machine compartment assembly into the machine compartment of the refrigeration unit.

According to yet another aspect of the present disclosure, the step of coupling the condenser to the base plate comprises coupling the condenser to a bracket that is coupled to the water tray.

According to yet another aspect, the present disclosure includes a step of connecting a pre-condenser tube to the compressor at a compressor joint and to the condenser at a condenser joint.

According to yet another aspect, the present disclosure includes a step of leak testing the compressor joint and the condenser joint. The step of leak testing the compressor joint and the condenser joint precedes the step of inserting the machine compartment assembly into the machine compartment.

According to yet another aspect, the present disclosure includes a step of coupling a condenser fan assembly to the base plate after the step of coupling the water tray to the base plate and before the step of inserting the machine compartment assembly into the machine compartment of the refrigeration unit.

According to yet another aspect of the present disclosure, the step of coupling the condenser fan assembly to the base plate comprises coupling the condenser fan assembly to the bracket that is coupled to the water tray.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration unit, comprising:

a cabinet; and a first evaporator assembly operable between an uninstalled condition, wherein the first evaporator assembly is not assembled with the cabinet, and an installed condition, wherein the first evaporator assembly is assembled with the cabinet, the first evaporator assembly comprising:

a first evaporator;

a first suction line connected to the first evaporator at a first suction line joint;

a first capillary tube connected to the first evaporator at a first capillary tube joint; and an insulating sleeve disposed about the first suction line and the first capillary tube, wherein the first suction line joint and the first capillary tube joint of the first evaporator assembly are leak testable in the uninstalled condition of the first evaporator assembly.

2. The refrigeration unit of claim 1, wherein the cabinet comprises:

an inner liner;

an outer wrapper, wherein the inner liner and outer wrapper cooperate to define an internal cavity for receiving insulation material therein; and a pass-through opening that extends through the inner liner and the outer wrapper, wherein the insulating sleeve, and the first capillary tube and first suction line disposed within the insulating sleeve, extend through the pass-through opening in the assembled condition of the first evaporator assembly.

3. The refrigeration unit of claim 1, wherein the first evaporator is positioned proximate to and is configured to cool a refrigerator compartment of the refrigeration unit in the installed condition of the first evaporator assembly.

4. The refrigeration unit of claim 1, further comprising:

a second evaporator assembly operable between an uninstalled condition, wherein the second evaporator assembly is not assembled with the cabinet, and an installed condition, wherein the second evaporator assembly is assembled with the cabinet, the second evaporator assembly comprising:

a second evaporator;

a second suction line connected to the second evaporator at a second suction line joint;

a second capillary tube connected to the second evaporator at a second capillary tube joint; and an insulating sleeve disposed about the second suction line and the second capillary tube, wherein the second suction line joint and the second capillary tube joint of the second evaporator assembly are leak testable in the uninstalled condition of the second evaporator assembly.

5. The refrigeration unit of claim 4, wherein the second evaporator is positioned proximate to and is configured to cool a freezer compartment of the refrigeration unit in the installed condition of the second evaporator assembly.

6. A method of assembling a refrigeration unit, comprising:

connecting a suction line to an evaporator at a suction line joint;

connecting a capillary tube to the evaporator at a capillary tube joint;

testing the suction line joint and capillary tube joint for leaks via a gas leak test;

inserting the suction line and capillary tube into an insulating sleeve; and installing the evaporator within a cabinet and feeding the suction line and capillary tube that are within the insulating sleeve through a pass-through opening defined by the cabinet after testing the suction line joint and capillary tube joint for leaks.

7. The method of claim 6, wherein the step of installing the evaporator within the cabinet and feeding the suction line and capillary tube that are within the insulating sleeve through the pass-through opening comprises feeding the suction line and capillary tube that are within the insulating sleeve through the pass-through opening that extends through an inner liner and an outer wrapper of the cabinet that cooperate to define an internal cavity for receiving insulation material therein.

8. The method of claim 6, wherein the step of installing the evaporator within the cabinet comprises positioning the evaporator proximate to a freezer compartment of the refrigeration unit, such that the evaporator is configured to cool the freezer compartment.

9. The method of claim 6, wherein the step of installing the evaporator within the cabinet comprises positioning the evaporator proximate to a refrigerator compartment of the refrigeration unit, such that the evaporator is configured to cool the refrigerator compartment.

10. A method of assembling a refrigeration unit, comprising:

inserting a machine compartment assembly, including a base plate and a compressor coupled to the base plate, into a machine compartment of the refrigeration unit;

mounting a control box of the refrigeration unit to a side panel; and coupling the side panel to the refrigeration unit, such that the side panel conceals a lateral side of the machine compartment and the control box is laterally-inboard of the side panel.

11. The method of claim 10, wherein the step of mounting the control box comprises mounting the control box to a portion of the side panel, such that the control box is wholly upward of the base plate when the machine compartment assembly is inserted into the machine compartment and the side panel is coupled to the refrigeration unit.

12. The method of claim 10, further comprising a step of:

coupling the compressor to the base plate, wherein the step of coupling the compressor to the base plate precedes the step of inserting the machine compartment assembly into the machine compartment of the refrigeration unit.

13. The method of claim 12, further comprising a step of:

coupling a water tray to the base plate, wherein the step of coupling the water tray to the base plate precedes the step of inserting the machine compartment assembly into the machine compartment of the refrigeration unit.

14. The method of claim 13, wherein the step of mounting the control box comprises mounting the control box to a portion of the side panel, such that the control box is wholly upward of an upper rim of the water tray when the machine compartment assembly is inserted into the machine compartment and the side panel is coupled to the refrigeration unit.

15. The method of claim 13, further comprising a step of:

coupling a condenser to the base plate after the step of coupling the water tray to the base plate and before the step of inserting the machine compartment assembly into the machine compartment of the refrigeration unit.

16. The method of claim 15, wherein the step of coupling the condenser to the base plate comprises coupling the condenser to a bracket that is coupled to the water tray.

17. The method of claim 15, further comprising a step of:

connecting a pre-condenser tube to the compressor at a compressor joint and to the condenser at a condenser joint.

18. The method of claim 17, further comprising a step of:

leak testing the compressor joint and the condenser joint, wherein the step of leak testing the compressor joint and the condenser joint precedes the step of inserting the machine compartment assembly into the machine compartment.

19. The method of claim 16, further comprising a step of:

coupling a condenser fan assembly to the base plate after the step of coupling the water tray to the base plate and before the step of inserting the machine compartment assembly into the machine compartment of the refrigeration unit.

20. The method of claim 19, wherein the step of coupling the condenser fan assembly to the base plate comprises coupling the condenser fan assembly to the bracket that is coupled to the water tray.

* * * * *